US006256839B1

(12) United States Patent
Wu

(10) Patent No.: US 6,256,839 B1
(45) Date of Patent: Jul. 10, 2001

(54) SPRING HINGE STRUCTURE

(76) Inventor: Chien-Chen Wu, No. 250, Yu Ai Street, Lu Kang Chen, Chang Hwa (TW)

( * ) Notice: Subject to any disclaimer, the term of this patent is extended or adjusted under 35 U.S.C. 154(b) by 0 days.

(21) Appl. No.: 09/375,513

(22) Filed: Aug. 17, 1999

(51) Int. Cl.[7] ..... E05D 13/06; E05F 1/14

(52) U.S. Cl. ..... 16/366; 16/50; 16/283; 16/301; 16/302

(58) Field of Search ..... 16/366, 302, 301, 16/282, 283, 285, 280, 287, 50, 76, 54, 68

(56) References Cited

U.S. PATENT DOCUMENTS

| | | | | |
|---|---|---|---|---|
| 727,697 | * | 5/1903 | Sargent | 16/283 |
| 966,380 | * | 8/1910 | Bommer | 16/283 |
| 971,281 | * | 9/1910 | Keene et al. | 16/301 |
| 1,138,484 | * | 5/1915 | Katzenberger | 16/283 |
| 3,965,533 | * | 6/1976 | Frohlich | 16/301 |
| 4,751,765 | * | 6/1988 | Wu | 16/301 |
| 4,756,051 | * | 7/1988 | Shy | 16/299 |
| 5,152,029 | * | 10/1992 | Pai | 16/54 |
| 5,383,253 | * | 1/1995 | Lin | 16/301 |
| 5,606,774 | | 3/1997 | Wu . | |

FOREIGN PATENT DOCUMENTS

| | | | | |
|---|---|---|---|---|
| 258540 | * | 12/1964 | (AU) | 16/301 |

* cited by examiner

*Primary Examiner*—Chuck Y. Mah

(57) ABSTRACT

The present invention provides a structure improvement of spring hinge which mainly utilizes the tension adjustment stand, made of plastic composite material, to simplify the composition in order to achieve the purposes of reducing cost and the difficulties in assembling, yet to preserve the original intended functions, and an insertion portion extended from the end of the torque spring to insert a insertion hole formed at the tension adjustment stand to enhance the stability of the positioning of the torque spring and to abrade the torque produced by the torque spring to avoid broken the end of the torque spring.

3 Claims, 10 Drawing Sheets

SPRING HINGE STRUCTURE

BACKGROUND OF THE INVENTION

The present invention relates to the hinges, and more particularly to a structure improvement of spring hinge, which is to place incision holes at the surface of the tension adjustment stands, and insert the insertion portions at two ends of the spring into these holes to increase the stability of the positioning of the torque spring, and to reduce the noise when operate, the difficulties in manufacturing and assembling, moreover, the tension adjustment stand made of plastic composite material because of the high durability, in order to avoid having the metal tubing part, and to simplify the composition such, and hence, reduce the difficulties in production and assembly.

FIG. 1 shows the prior art of a regular hinge used in large-scale heavy duty doors. This kind of the hinge is composed of a double-tube base plate 10, a pair of torque springs 12 placed inner of the tubes 11, and a pair of tension adjustment stands 13, 13' placed at the ends of the tubes 11. Place the ends 121 of the torque spring 12 inner the bottom of the trench, at the perimeter of the tension adjustment stand 13, setup a plurality of adjustment holes 132 at equal distance in order to use a double-headed pin 14 to adjust the tension of the spring 12. Also, there are a pair of turning flanges 20 that utilize the tips of the rods 22 to connect the tubes 11 at turned angle of the flanges 21, and then, fasten the ends of the tubes 11 with a pair of threaded caps 23. FIG. 2 shows an assembled spring hinge of FIG. 1. This kind of the spring hinge utilizes the torque spring to store the tensile strength in order to accomplish the function of automatic door closing. However, this design included the following disadvantages:

1) The tension adjustment stand is made of metal, the manufacturing of such is difficult and expensive.
2) Furthermore, the stair-like hard surface is closely attached to the interior walls of the tubes 11, after constant torque and turns, the diameters of the tubes will expand, which in turn, causes the hinge to disfigure.
3) Because the axle tips 22 are also made of metal, and the axles pass through the center of the tension adjustment base 13. Furthermore, the a pair of tips of the torque springs 22 only rest on the groves of the tension adjustment bases 13, that is, the a pair of ends of the torque springs circle around the stair-like surface of the tension adjustment bases. So when the torque spring 22 turns against the tension adjustment base, the movements are apparent and the contacts between the axle tips 22 and the interior walls create noises. If cracks appear at the trench 131, it must be damaged by the torque of the spring 12.

Based on the aforementioned disadvantages of the prior art, the applicant reinvented an improved spring hinge which had already granted patent by the U.S. PTO (Application Filed Number 08/590,631), please refer to FIGS. 3 and 4, which consists of a rectangular base plate 30 with a pair of tubes at the sides, as a unit, to form a pair of guiding tubes 31, each of the guiding tube 31 contains a torque spring 32, a ring cap 35 with a protruding lip 351 that matches with the diameter of the guiding tube 31, and a first tension adjustment stand 33 made of plastic, which further contains a small metal tube 34 clips onto one end of the torque spring 32. The first tension adjustment stand 33 inserts into a tip of the tube 31 and utilizes its cylindrical main body to rest on the ring cap 35, a second tension adjustment stand 36, made of plastic, directly inlays into the bottom of the guiding tube 31 where it also contains a small metal tube 34' for clipping unto the other end of the torque spring 32. A pair of flanges 40 using their turned angle protrusions 41 to hold the exteriors of the first and second tension adjustment stands 33 and 36, and utilizing the tip of an axle rods 50 and a threaded cap 52 to connect to the second guiding tube 31. A pair of adjustment pins 60 are inserted into an adjustment holes 336 at the perimeter of the first adjustment stand 33 for adjustment of the tension at the torque spring 32 and to press against the ends of the flanges 40.

With the aforementioned improvement, the spring hinge will smoothly closes the door automatically without any noise or distortion. These improved portions are enough to ensure the structural stability, enhance durability, and increase actual functions. However, though the first and second adjustment stands 33 and 36 are made of enhanced plastic, still the inserted small metal tubes 34 and 34' are necessary to sustain the opposite force exerted at the ends of the torque spring 32. Otherwise, under the constant torque resistance from the torque spring 32, the ends of the spring is likely to damage the first and second adjustment stands 33 and 36. The small metal tubes 34 and 34' are actually made of sheet metal bend into a tubular shape. When they are inserted into the first and second adjustment stands 33 and 36, because of their elastic nature, they are closely fitted into the first and second adjustment stands 33 and 36, hence they won't fall off the first and second adjustment stands 33 and 36. The small metal tubes 34 and 34' are difficult to manufacture, and the assembling of these tubes into the first and second adjustment stands 33 and 36 are quite difficult. Moreover, the end of the spring of the torque spring 32 winds into the side opening of the small metal tubes 34 and 34', and positioned through these small metal tubes 34 and 34'. When the torque spring 32 turns, because of the tension is concentrate in the end of the spring 32, the end of the spring 32 will fall off easily and cause a separation with the small metal tubes 34 and 34' to cause any possible dangerous. The positioning of the torque spring 32 is not stable nor is it reliable, and the part of the stands 33 and 36 which touch with the end of the spring 32 will distract because of the torque spring 32 is in operate.

The present invention is arisen to militate and/or obviate the aforediscussed disadvantages in order to provide a new and novel structure hereinafter.

SUMMARY OF THE PRESENT INVENTION

The present invention has a main object to provide a structure improvement of spring hinge, which is to place incision holes at the ends of the tension adjustment stands, and insert the insertion portions at two ends of the spring into the holes to increase the stability of the positioining of the torque spring, and to reduce noises when operate, and to reduce the difficulties in manufacturing and assembling.

Another object of the present invention is to provide a structure improvement of spring hinge, which has a tension adjustment stand made of plastic composite material because of the high durability, in order to avoid having the metal tubing part, and to simplify the composition such, and hence, reduce the difficulties in production and assembly.

The present invention will become more fully understood by reference to the following detailed description thereof when read in conjunction with the attached drawings.

DETAILED DESCRIPTION OF THE PREFERRED EMBODIMENT

Figure 1:
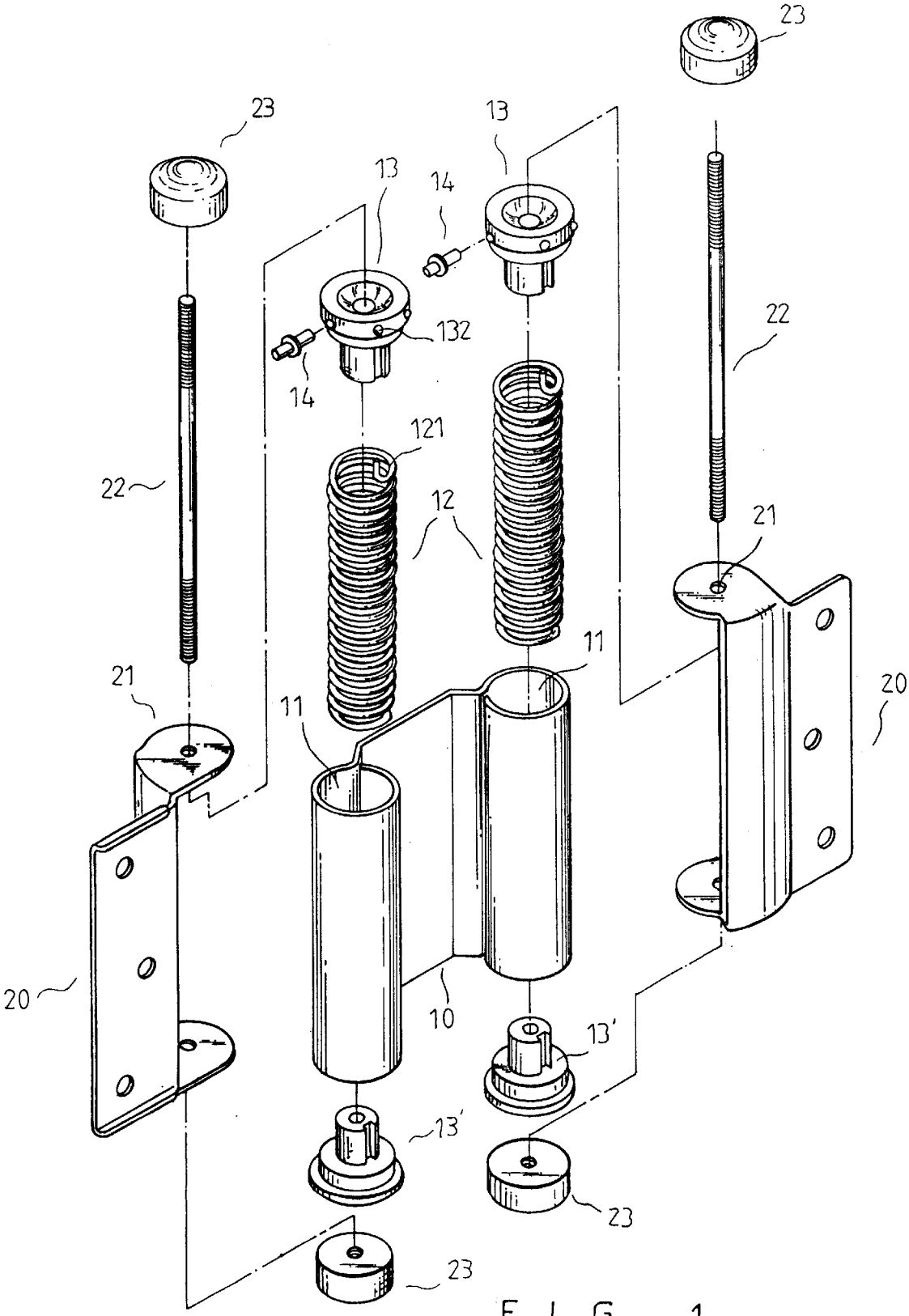
F I G. 1 PRIOR ART
FIG. 1 is an exploded perspective view to show the prior art of the spring hinge.
Figure 2:
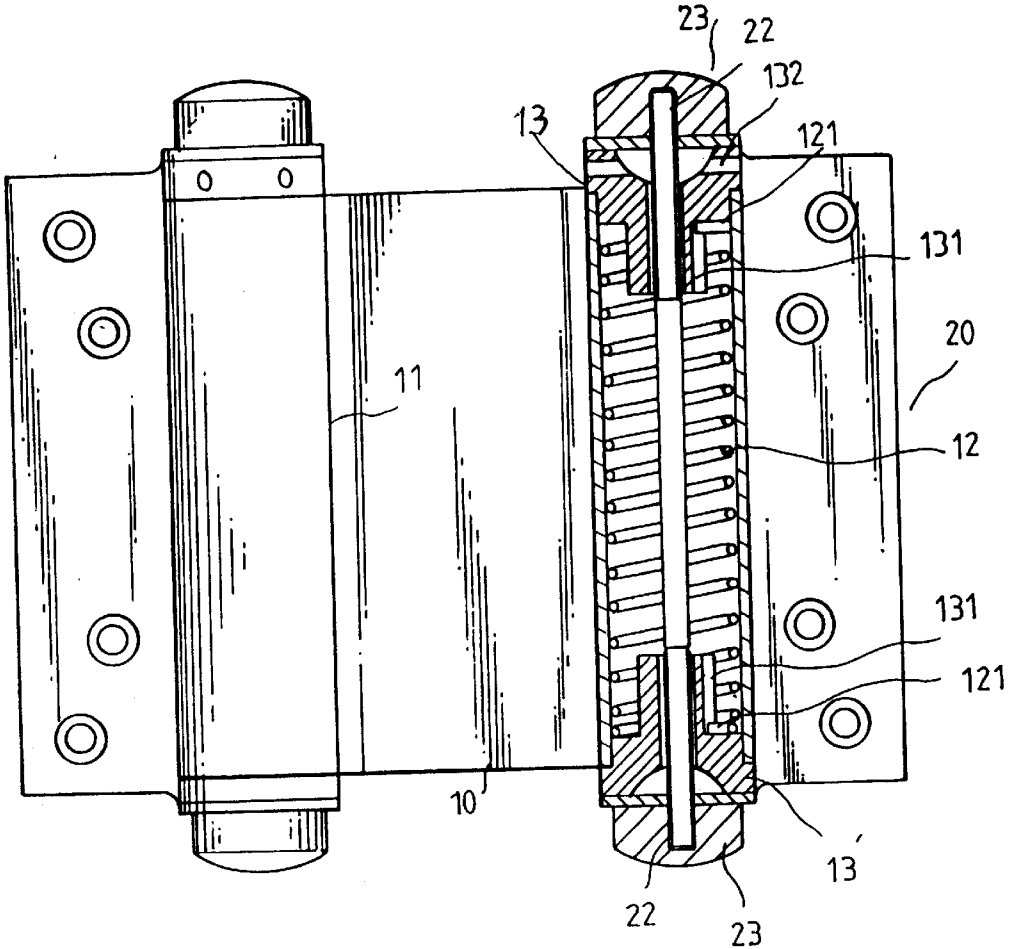
FIG. 2 PRIOR ART
FIG. 2 is an assembled partially sectional view of the FIG. 1.
Figure 3:
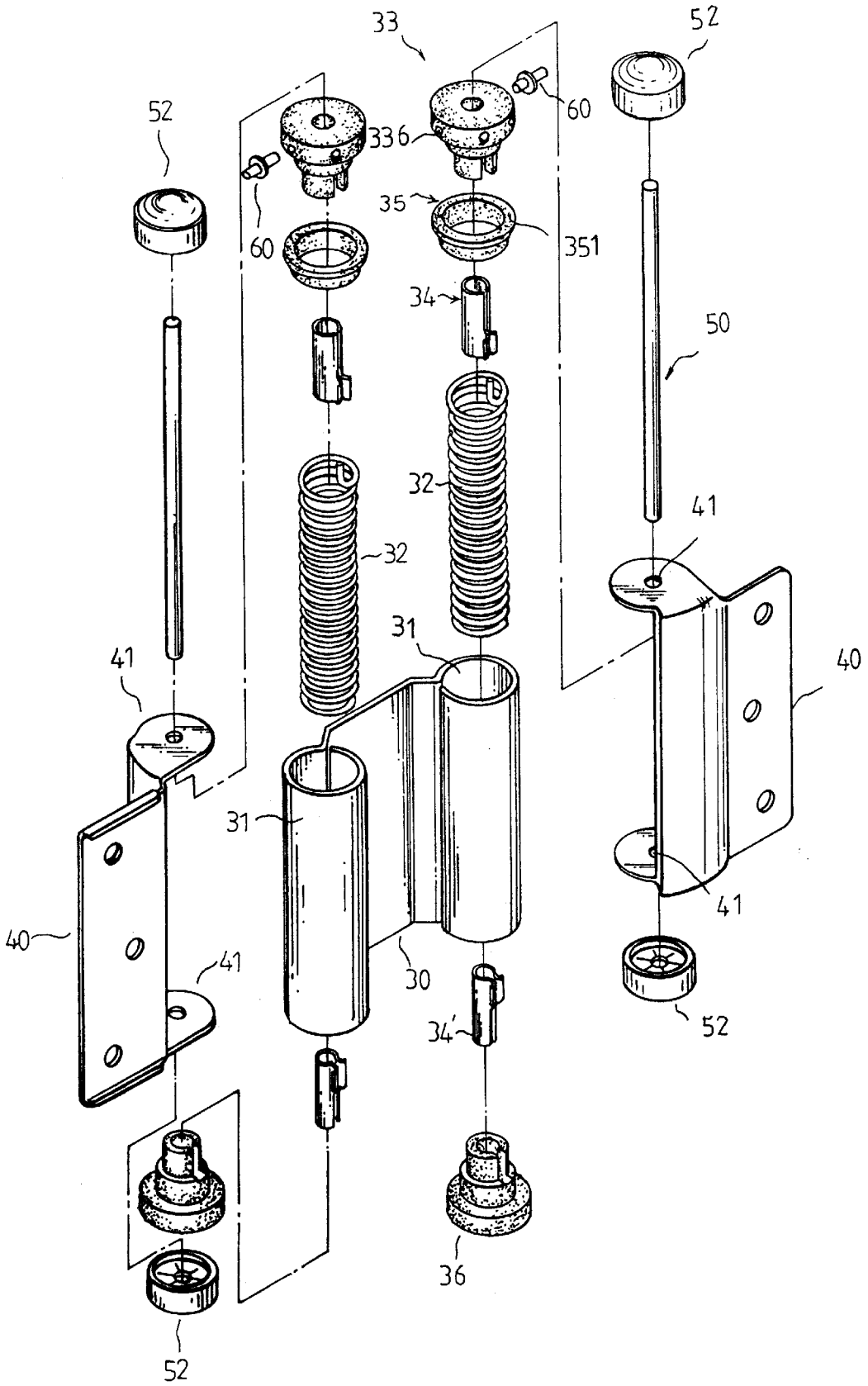
FIG. 3 is an exploded perspective view to show the U.S. patent application Ser. No. 08/590,631.
Figure 4:
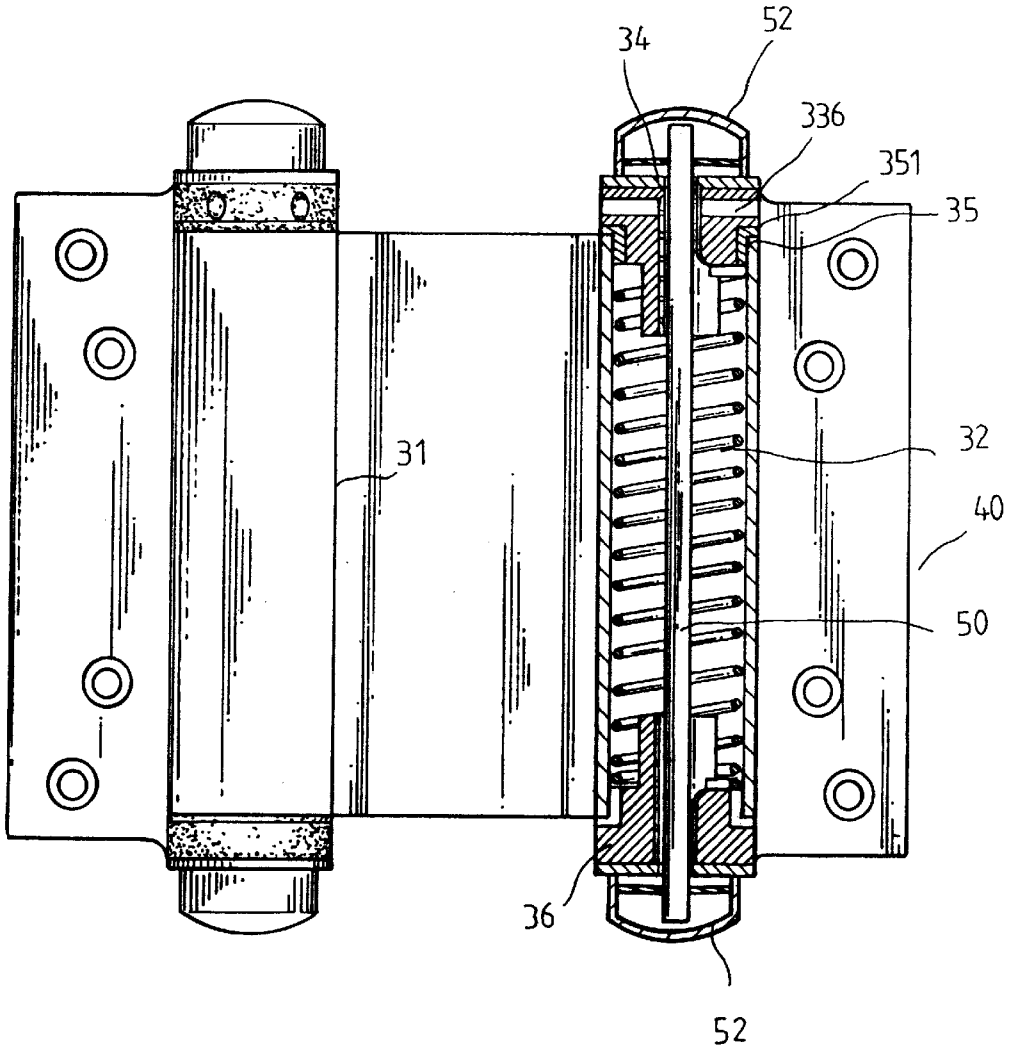
FIG. 4 is an assembled partially sectional view of the FIG. 3.
Figure 5:
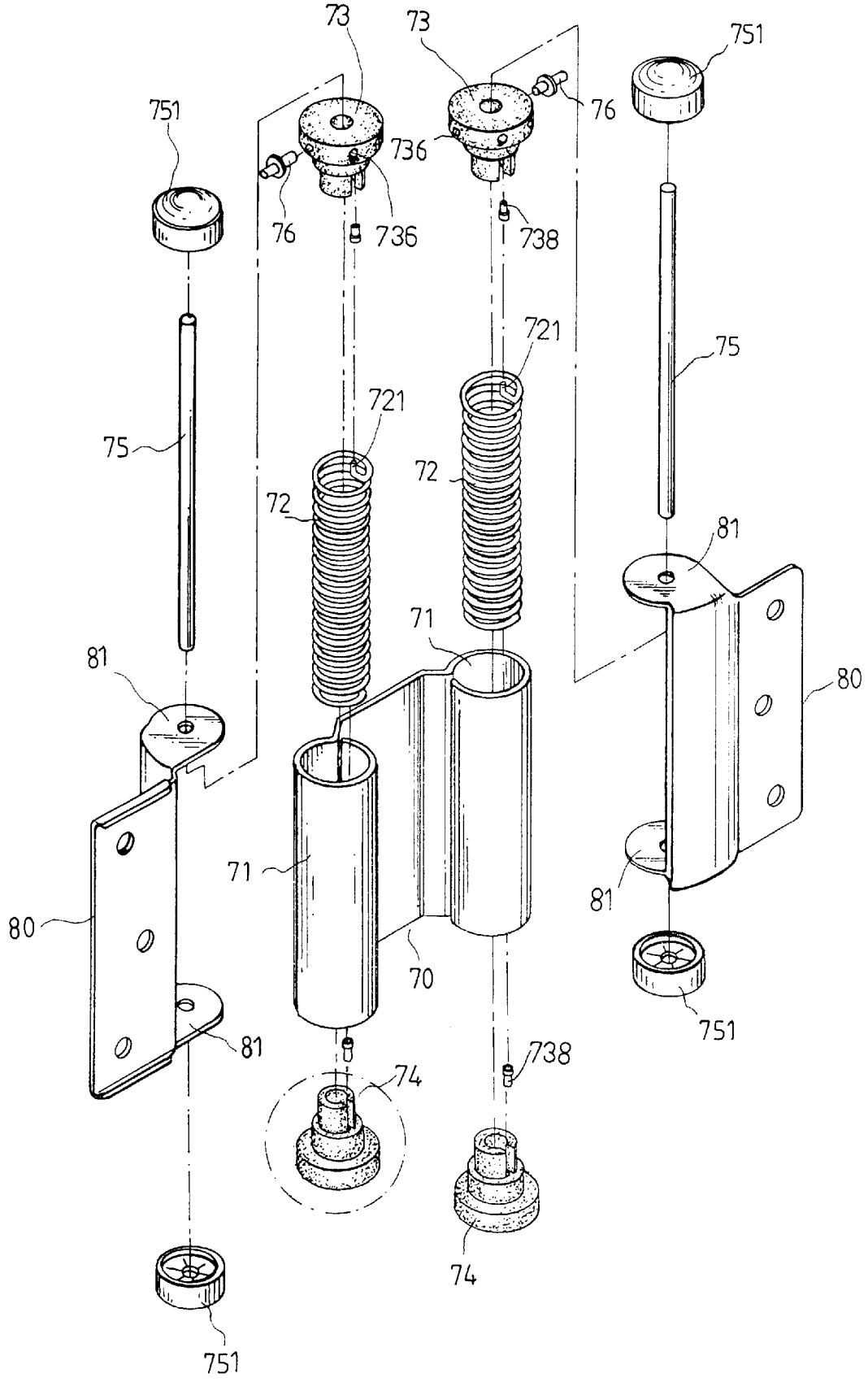
FIG. 5 is an exploded perspective view to show the first preferred embodiment of the present invention.
Figure 6:
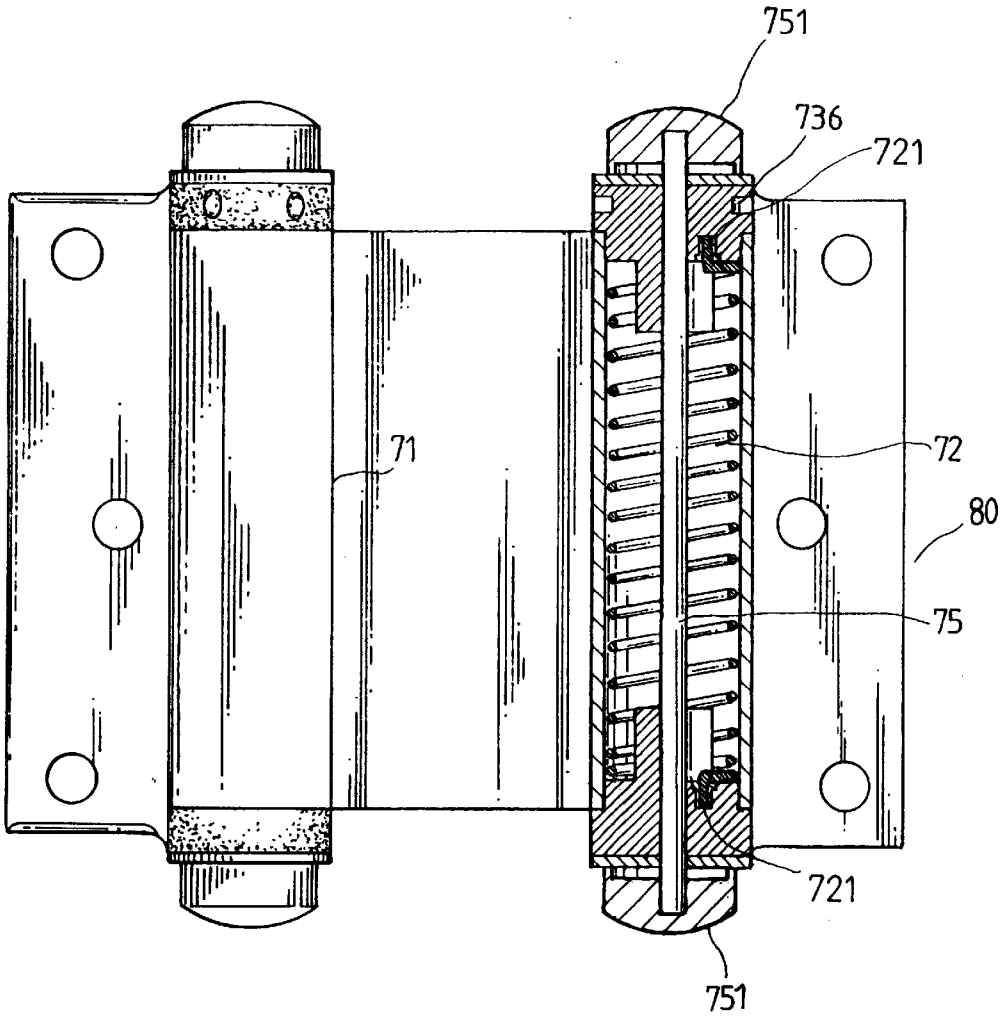
FIG. 6 is an assembled partially sectional view to show the second preferred embodiment of the present invention.

Please refer to the drawings from FIGS. 5 and 6, the present invention of the improved structure of spring hinge, which comprises generally a rectangular base plate 70, a pair of hollow cylindrical guiding tubes 71 connected to the base plate 70 on both sides, a pair of torque springs 72 placed into the guiding tubes 71, a pair of first tension adjustment stands 73 positioned at the top of the guiding tubes 71, a pair of second tension adjustment stands 74 pivoted at the bottom of the guiding tubes 71, a pair of flanges 80 with their protruding plates 81 held unto the outside of the first and second tension adjustment stands 73 and 74, a pair of axle rods 75 is penetrated into the guiding tubes 71 with the torque spring 72 and out of the guiding tubes 71, then positioned the rods 75 with a pair of caps 751. Finally, plug the ends of a pair of tension adjustment pins 76 into a pair of adjustment holes 736 formed at the outside perimeter of the first adjustment stands 73, to adjust the torque spring 72 to an appropriate tension, whereas, the other end of the pins 736 is against at the top of the protruding angles of the flanges 80.

The torque spring 72 has a section inwardly extended, and then axially extended outward to formed an insertion portion 721.

Figure 5A:
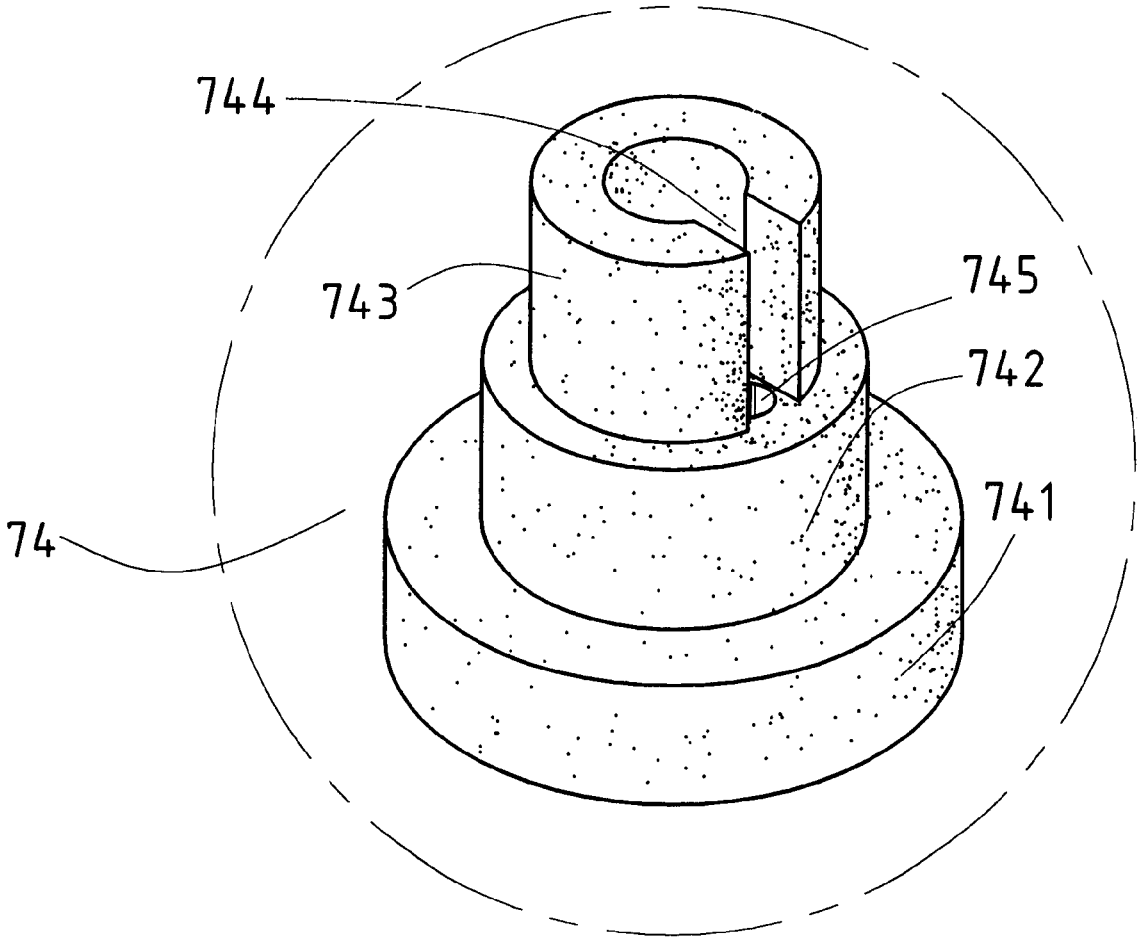
FIG. 5A is a perspective view to show the large scale of the tension adjustment stand of FIG. 5.

The second tension adjustment stands 74 are made through plastic injection mold, as shown in FIG. 5A, which comprising a hollow lower section 741 whose outside diameter matches the inner diameter of that of the guiding tube 71, a hollow middle portion 742 and a hollow upper portion 743, an opening 744 located at periphery of the upper portion 743, an insertion hole 745 located at the perimeter of the opening 744.

The second tension adjustment stands 74 are also formed with plastic composite material, aside from the absence of the adjustment hole at the outside perimeter, the structure and shape of the second tension adjustment stands 74 are similar to the first tension adjustment stands 73.

For assembly, the insertion portion 721 of the torque spring 72 winds into the opening 744 and continues to insert into the insertion hole 745, so one side of the torque spring 72 can be fitted into the perimeter of the upper portion 743. The upper portion 743 serves as a binding to one end of the torque spring 72, at the same time, the middle portion 742 will distribute the torque exerted to the first and the second tension adjustment stands 73 and 74, from the torque spring 72 through the opening 744 and the insertion hole 745 to avoid broken the end of the torque spring 72 and not to-cause abraded the periphery of the middle portion 743 by the end of the torque spring 72. And through the insertion hole 745, the torque spring 72 is stabilized. The reliability is enhanced; the difficulties in manufacturing and assembling are reduced. Furthermore, inner of the insertion hole 745 is penetrated with a metal tubing 738, so one end of the torque spring 72 is placed inner the metal tubing 738 to increase the strength of the tension adjustment stand.

The function of the metal tubing 738 was increase strength of the insertion hole 745 not to broken when the torque against to the insertion hole 745, but if the material of the tension adjustment stand strong enough to against the torque induced by the torque spring 72 and not to broken, the metal tubing 738 can be move from the insertion hole 745.

Figure 7:
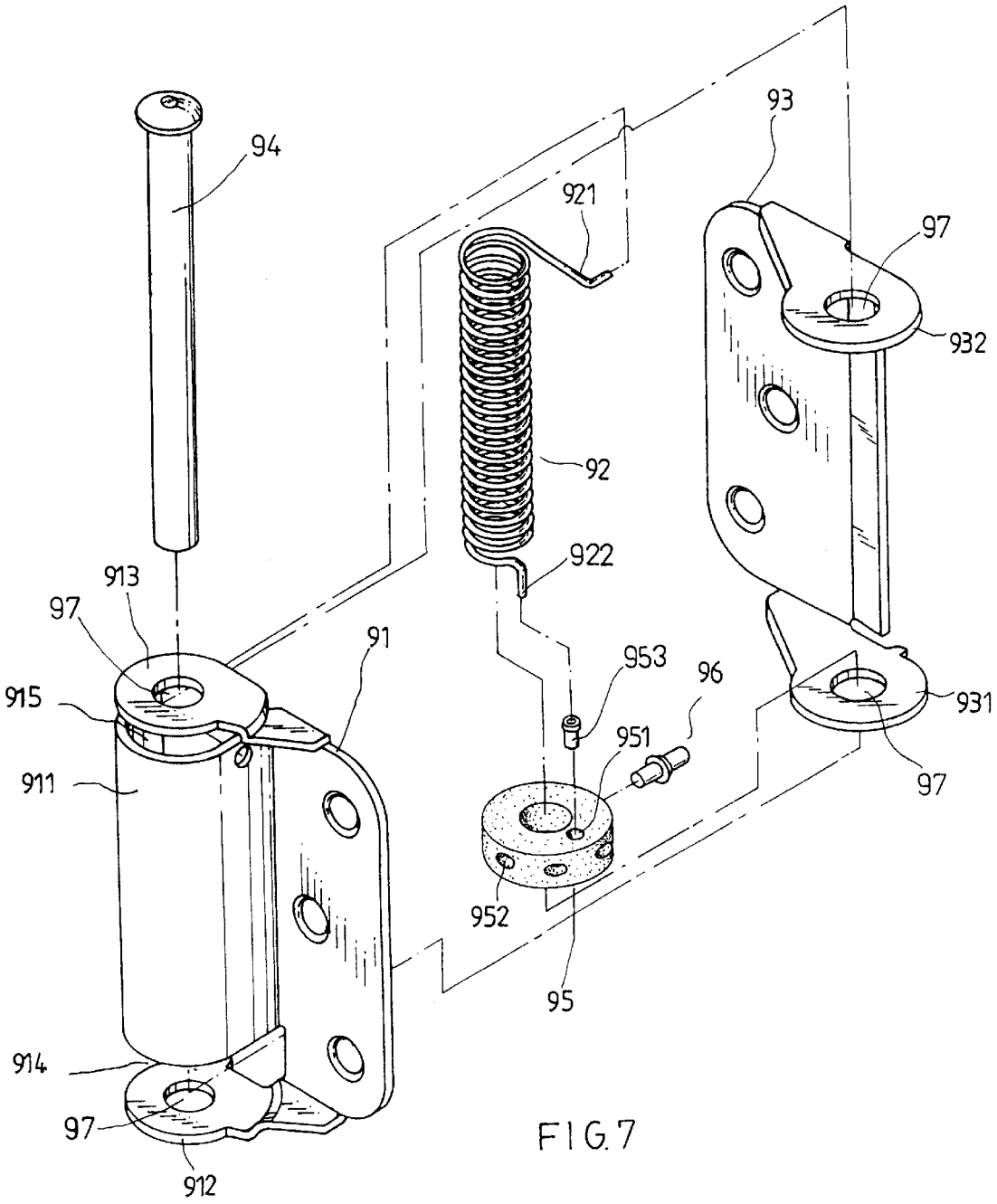
FIG. 7 is an assembled partially sectional view to show the second preferred embodiment of the present invention.

Refer to FIG. 7, the second preferred embodiment of the present invention, a structure improvement of spring hinge, which applying in light duty door comprises a first and second leaf blades 91 and 93, whereas, the periphery of the first leaf blade 91 extended with an arc shape protective cap 911 to formed a space to receive a torque spring 92 with a an axle rod 94 and a tension adjustment stand 95, two ends of the first leaf blade 91 correspondingly bended into an certain angles to formed a first flange 912 and a second flange 913, the length of the protective cap 911 is shorter than the distance between the first flange 912 and the second flange 913 to formed a first and second inserted gaps 914 and 915, in order to insert a third and fourth flanges 931, 932 of the second leaf blade 93, each of the first, second, third and fourth flanges 912, 913, 931 and 932 have a hole 97, the axle rod 94 penetrated through the hole 97 of the first and second flange 912 and 913, with the torque spring 92 and then through the third and fourth flanges 931 and 932 and out of the hole 97 of the first flange 912.

The axle rod 94 penetrated the tension adjustment stand 95 between the torque spring 92 and the first flange 912. The tension adjustment stand 95 modified from the previously described a first adjustment stand 73 of the first preferred embodiment of the present invention. The tension adjustment stand 95 is in cylindrical shape also made of lightweight and durable plastic composite material. The surface of the tension adjustment stand 95 horizontally contacted with the surface of the first flange 912, the other surface of the tension adjustment stand 95 has an insertion hole 951, and the inner of the insertion hole 951 is positioned with a metal tubing 952 then receive a insert portion 922 of the torque spring 92 into the metal tubing 952, such is to increase the strength of the insertion hole 951 during the torque movement of the torque spring 92. With the insert portion 922 of the torque spring 92 inserted into the insertion hole 951 while the other end of the spring torque 92 is extended with an arm 921. The arm 921 extends from the periphery of the protective cap 911 and against to the perimeter of the second leaf blade 93 to position the torque spring 92. A plurality of adjustment holes 952 with same internal diameter, located around the perimeter of the tension adjustment stand 95, where a insertion pin 96 can be inserted into any adjustment hole 951 to push turn the tension adjustment stand 95 and to set the twist of the torque spring 92.

Figure 8:
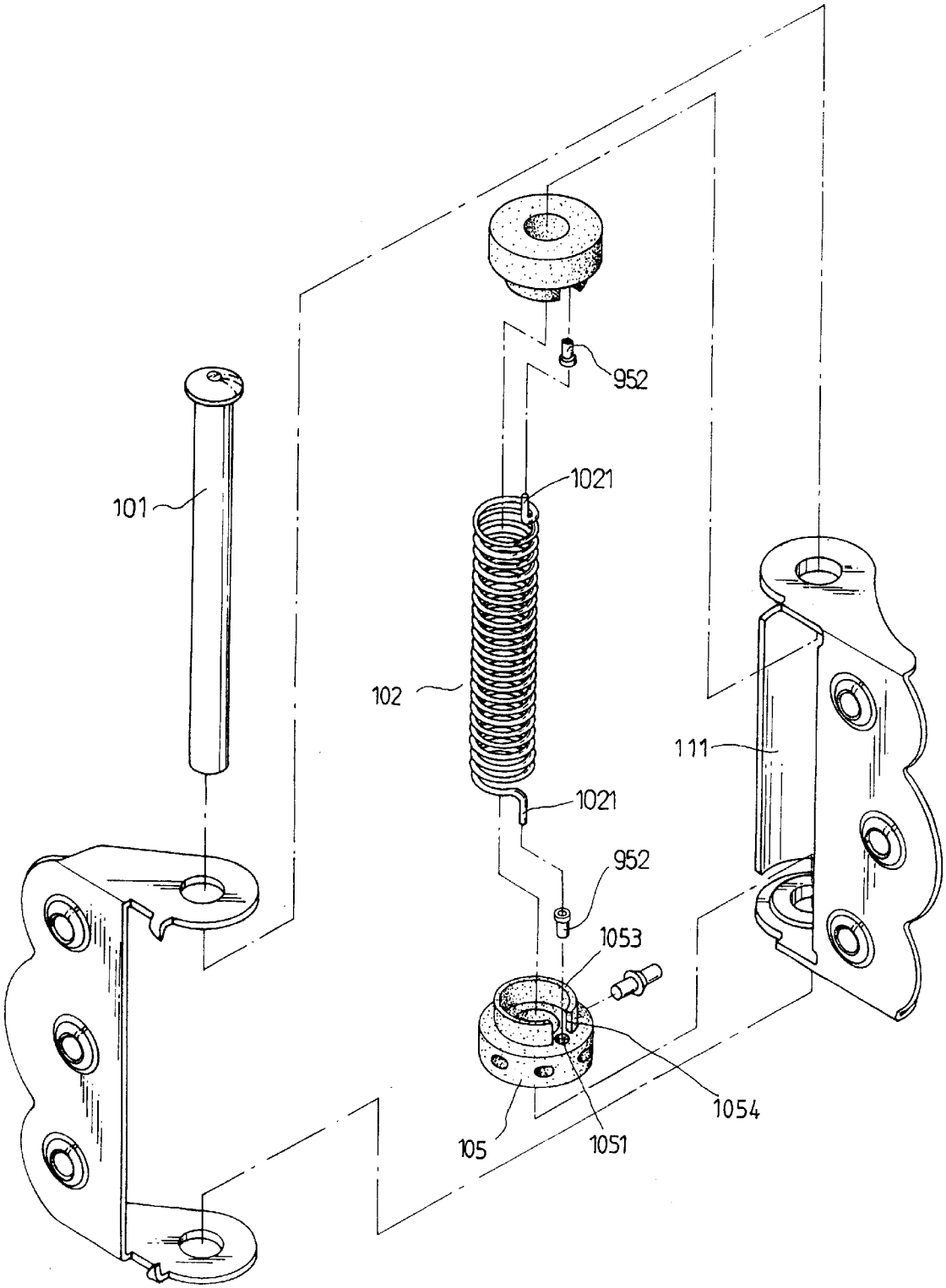
FIG. 8 is a perspective view to show the third preferred embodiment of the present invention.
Figure 9:
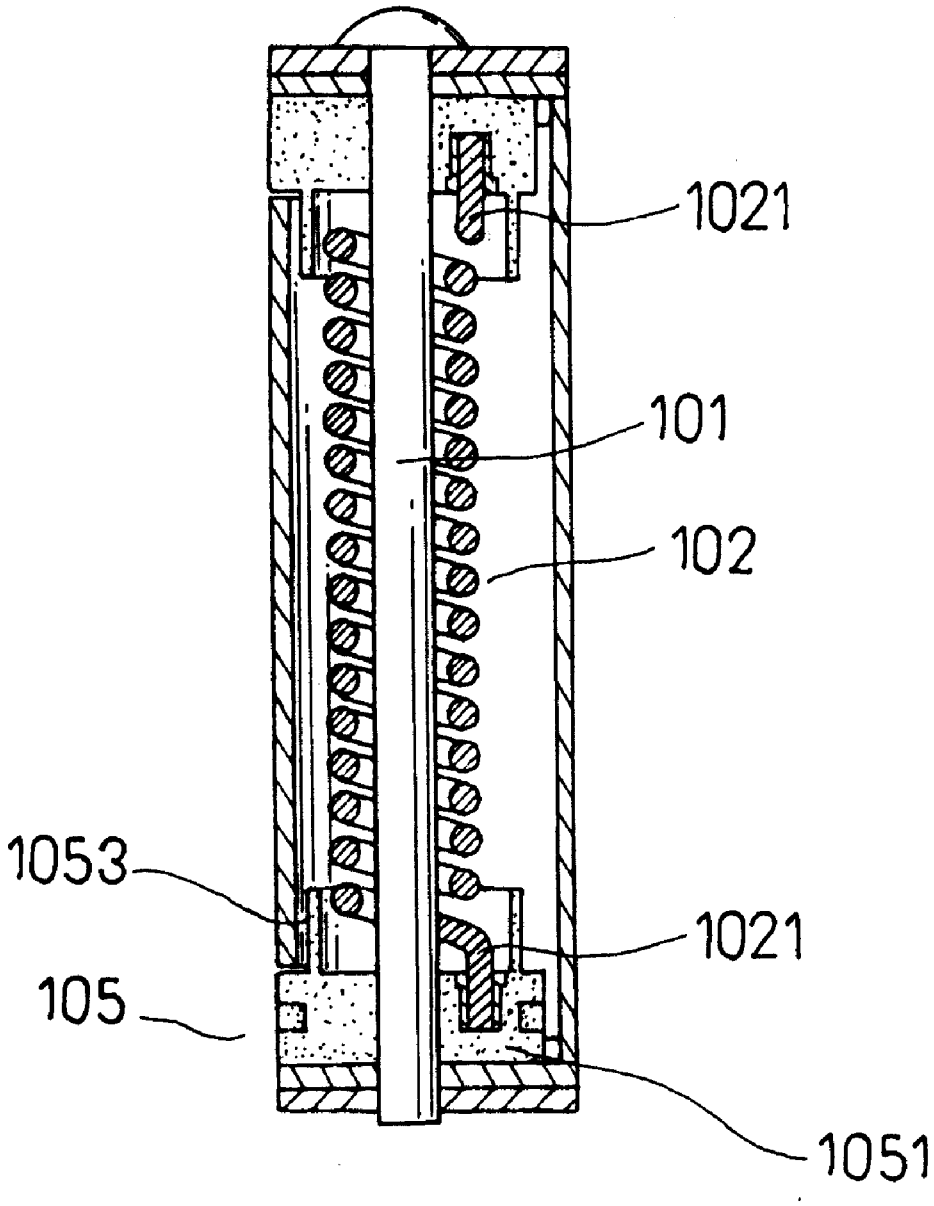
FIG. 9 is an assembled partially sectional view to show the third preferred embodiment of the present invention.

Refer to FIGS. 8 and 9, there is a little different from the second preferred embodiments. The difference between the second and third preferred embodiments are two ends of the axle rod 101 placed with a pair of tension adjustment stands 105, the tension adjustment stands 105 are similar to the tension adjustment stand 95 in FIG. 7, the different is on the same surface of a insertion hole 1051 of the tension adjustment stand 105 have a protective ring 1053, the other different are a pair of insertion portion 1021 each axially outward from the ends of a torque spring 102, the insertion hole 1051 receive a metal tubing 952, for insertion portion 1021 of the torque spring 102 winds into the metal tubing 952, to avoid overly concentrating the torque, so the tension adjustment stands 105 and 105' of this embodiment, where the appropriate height of protective rings 1053 are receive the ends of the torque spring 102. The protective rings 1053 are wrapped around the periphery of the torque spring 102 to cover the ends of the torque spring 102 and to position the torque spring 102. So the insertion portion 1021 of the torque spring 102 is wrapped in the protective rings 1053 and 1053' for holding purpose. So the torque spring 72 will preserves the direction of an axle rod 101, and when the torque spring 102 is twisted, it won't shake nor will it touches the protective covers 111 or the axle rod 102 to create noise that further extend the life of the spring hinge. The protective ring 1053 cut with an opening 1054 and a plurality of insertion holes 1051 formed at peripheral of the stand 105. The ends of the torque spring 102 placed into the internal space of the protective ring 1053 and the insertion portion 1021 penetrated into the insertion hole 1051 to stabilize the torque spring 102 and to distribute the torque through the insertion holes 1051;

Note that the specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A spring hinge structure comprising a rectangular base plate, two hollow guiding tubes respectively connected to two opposite sides of the base plate, a pair of torque springs respectively received in the guiding tubes, each end of the torque spring having an insertion portion, a pair of first tension adjustment stands positioned at two respective tops of the guiding tubes, a pair of second tension adjustment stands pivoted at two respective bottoms of the guiding tubes, a pair of flanges each having two protruding plates which are respectively connected to the peripheries of the first and second tension adjustment stands, a pair of axle rods inserted into the guide tubes and two respective ends of the axle rods extending through the guiding tubes and connected to two caps, a pair of tension adjustment pins with one end thereof inserted respective into an adjustment hole located at the perimeter of each first tension adjustment stand and the other end of the pin against the protruding plate, each of the first and second tension adjustment stands further comprising a hollow lower portion, a hollow middle portion and a hollow upper portion, the upper portion consisted of a cut opening, and the insertion portion of each torque spring inserted into a respective insertion hole in each tension adjustment stand, wherein a metal tubing is inserted into the insertion hole and the insertion portion of the torque spring is inserted into the metal tubing.

2. A spring hinge structure comprising a set of leaf blades including first and second leaf blades, a perimeter of the first leaf blade extended with an arc shape protective cover with a torque spring placed into the protective cover, one end of the torque spring having an insertion portion, first and second flanges extending from two opposite edges of the first leaf blade, the second leaf blade having third and fourth flanges which are respectively received in gaps between two ends of the protective cover and the first and second flanges, an axle rod penetrated through each flange and into the torque spring, the axle rod penetrated through a tension adjustment stand between the torque spring and the first flange, one edge of the tension adjustment stand horizontally contacting the first flange and the other edge of the tension adjustment stand indented with an insertion hole, the insertion portion of the torque spring extending from the bottom of the perimeter of the protective cover and engaged with a perimeter of the second leaf blade, a plurality of insertion holes formed at the periphery of the tension adjustment stand and an insertion pin inserted into the insertion hole, a metal tubing inserted into the insertion hole and the insertion portion of the torque spring inserted into the metal tubing.

3. the spring hinge structure as recited in claim 2, wherein two ends of the axle rod are respectivey placed with two tension adjustment stands, a protective ring extending from each of the tension adjustment stands and encompassed by the torque spring, the protective ring having an opening, an end of the torque spring wired into the cut opening and penetrated into the insertion hole to position the torque spring.

* * * * *